United States Patent [19]

Wilson

[11] Patent Number: 4,691,484

[45] Date of Patent: Sep. 8, 1987

[54] EXPANDABLE DECK SYSTEM

[76] Inventor: James W. Wilson, Rte. 2, Box 750, Big Sandy, Tenn. 38221

[21] Appl. No.: 839,600

[22] Filed: Mar. 14, 1986

[51] Int. Cl.[4] ..... E04F 11/10; E04B 1/343

[52] U.S. Cl. ..... 52/79.6; 52/79.5; 52/184

[58] Field of Search ..... 52/79.6, 79.5, 184

[56] References Cited

U.S. PATENT DOCUMENTS

| | | | |
|---|---|---|---|
| 3,808,757 | 5/1974 | Greenwood | 52/79.6 X |
| 3,875,707 | 4/1975 | Horn | 52/184 |
| 4,413,855 | 11/1983 | Flanagan | 52/79.6 X |
| 4,419,851 | 12/1983 | Kruger | 52/184 |
| 4,468,901 | 9/1984 | Henderson et al. | 52/79.6 |
| 4,527,366 | 7/1985 | Green et al. | 52/184 |

*Primary Examiner*—J. Karl Bell

*Attorney, Agent, or Firm*—Stanley R. Moore

[57] ABSTRACT

A portable deck system comprising a fixed deck surface adapted for structural support through side panel secured thereto and expandable for adaptation to a plurality of sizes. The fixed deck portion is constructed of a wooden frame and deck members adapted for securement to a plurality of other platform sections for expansion in orthogonal directions to form a deck of unlimited size and shape. The side rail frames are constructed for securement to said platform along the edges thereof in structural truss interengagement therewith for providing requisite rigidity for a multiplicity of uses. The side rail sections and steps are constructed for coupling to said platform along interchangeable end portions thereof to facilitate adaptation of the deck to motor homes and the like facilitating selection of direction of entry or assembly. The platform section and side rail truss sections are fixedly preasembled for affording structural integrity thereto, facilitating interengagement with one another, and enhancing both the assembly and disassembly thereof. In this manner a deck system of any size and shape can be packaged and shipped in a collapses configuration in motor homes, trailers and the like for quick assembly.

17 Claims, 4 Drawing Figures

EXPANDABLE DECK SYSTEM

BACKGROUND OF THE INVENTION

1. Field of the Invention

The present invention relates to platform assemblies and, more particularly, to a portable deck system adapted for expandable assembly with structurally interconnecting side rail members.

2. History of the Prior Art

The advent of portable buildings such as manufactured housing, mobile homes, and transportable commercial units has necessitated a myriad of complementary structures facilitating the comfort and use of such portable buildings. For example, porches, sidewalks, decks and carports are often constructed adjacent manufactured housing to enhance their use. Generally, these structures are fixedly assembled from wood and/or concrete in the same manner that porches and garages are assembled adjacent permanent structures. Unfortunately, such units can be moved after a period of time which is, of course, inherent in the concept of mobile homes and mobile home parks. The permanent structures are seldom usable for subsequent occupants due to varying size and shape of mobile home structures and occupant preferences. Therefore, the permanent structures can become delapidated or destroyed which is both costly and wasteful.

More conventional prior art designs for mobile home parks and the like have incorporated wooden structures which are more easily disassembled after their intended use. The utilization of fiberglass panels for carport roof sections as well as prefabricted steel sections for carport support frames have likewise been found effective in this particular application. Heavy gauge steel and the like is, of course, not extremely portable relative to residential mobile homes and, therefore, simply provide a cost effective expedient to carport and collateral structure assembly methods.

Mobile home decks and stairways have likewise utilized concrete or basic steel structures which can require very few structural members and which are cost effective in temporary use. These assemblies are, however, not as aesthetically pleasing as many wooden structures fabricated from redwood, cedar and the like which is of particular import to owners of more expensive mobile homes as well as their use in commercial applications. For example, many commercial trailers, vans and the like are used for portable offices, shows and displays. Real estate sales offices at remote locations such as newly designed developments necessitate portable offices and buildings, the owners of which require an aesthetically pleasing appearance. For this reason, wooden platforms are generally constructed as porches and decks adjacent to the office buildings. In the area of recreation, lakeside decks, walks and piers are often constructed from wood for purposes of facilitating use of the lake, the appearance thereof, and access thereto. The conventional method of assembling such wood structures generally includes the use of nails which fixedly secure the structure together and prevent its disassembly without substantial damage. Moreover, the necessity for low cost assemblies in such wooden structures generally limit the degree of structural integrity provided by the wooden structure. This is particularly critical in commercial platform and deck applications where a plurality of people may assemble. Nails very often do not provide adequate structural interengagement when such weights are encountered and particularly in view of the fact that the structural design is often limited to single brace members incorporated for support of a single surface.

It would be an advantage therefore to overcome the problems of the prior art by providing a wooden deck assembly which was both structurally sound and portable in nature to facilitate uses in remote locations. The deck system of the present invention provides such an assembly by incorporating preassembled, fixedly secured platform and side rail truss members adapted for being coupled one to the other in structural interengagement therebetween in a myriad of designs, sizes and shapes. The side rail trusses are fabricated from wood in a decorative configuration which also provides the function of a truss when secured to distal ends and an intermediate section of the platform. The utilization of lag bolts for assembly and disassembly of the aforesaid fixedly assembled sections permits portability while maintaining structural integrity of the unit.

SUMMARY OF THE INVENTION

The present invention pertains to portable deck structures comprising a fixedly assembled platform and side rail sections adapted for structural interengagement one to the other. More particularly, the present invention relates to an improved deck system of the type where in a wooden platform is constructed with side panels at least partially therearound and steps providing access thereto. The improvement comprises a portable deck structure including a fixedly assembled platform, fixedly assembled longitudinal side panel, fixedly assembled end panel, fixedly assembled step section and plurality of structural members adapted for securing the platform, steps, side and end panels one to the other and to a supporting surface. The longitudinal side panel is further constructed in the form of a structural truss and includes a center attachment beam for coupling an intermediate section of the platform to the side panel. The side panel is adapted for interchangeability on opposite sides and ends of the platform. The step section is also adapted for securement to either end of the platform, and the platform is adapted for attachment to a second platform positioned on either end or side thereof facilitating bi-directional expansion of the deck system.

In another aspect, the deck system further comprises L-shaped corner posts and apertures formed therethrough adapted for receiving lag bolts. The lag bolts are adapted for being received through the apertures in the posts and the platform, which includes a plurality of apertures formed therein adapted for alignment and registry with the apertures of the posts for the receipt of the lag bolts therein. The platform, the side panels and the steps are preferably formed of pressure treated wood and include upper and lower elongate rails and lattice members or pickets at 45° positioned in a diametric design secured therebetween. The upper and lower rails have opposite ends cut at 45° angles facilitating orthogonal engagement therebetween on opposite ends thereof for facilitating selection and mounting to the platform.

BRIEF DESCRIPTION OF THE DRAWINGS

For a more complete understanding of the present invention and for further objects and advantages thereof, reference may now be had to the following description taken in conjunction with the accompanying drawings in which.

DETAILED DESCRIPTION OF THE PREFERRED EMBODIMENT

Figure 1:
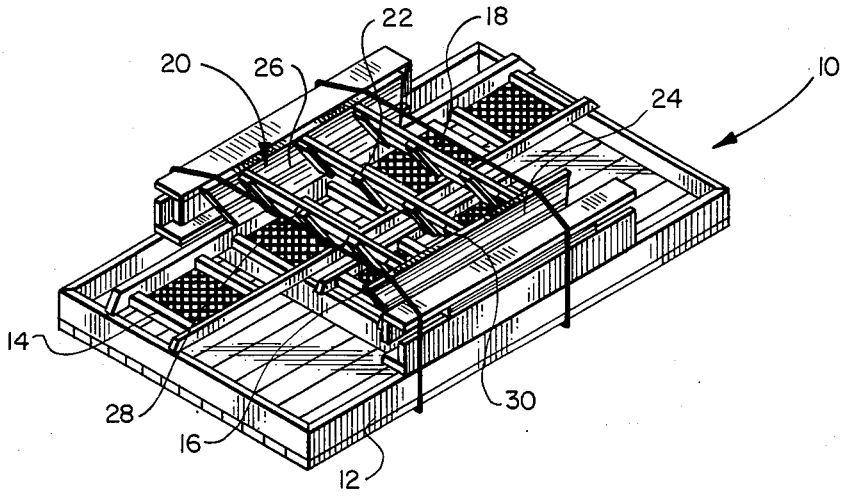
FIG. 1 is a perspective view of a collapsed deck system constructed in accordance with the principles of the present invention.

Referring first to FIG. 1 there is shown the portable deck system of the present invention in a disassembled and transportable configuration. The deck system 10 comprises a fixedly assembled platform 12, a longitudinal side rail panel 14, end panel 16, steps 18 and structural members 20 packaged and found in a collapsed configuration. Each of the aforesaid members of the system 10 have been permanently assembled with securing fasteners to provide a structurally sound component to the overall structural system. The steps 18, for example, incorporate a plurality of step sections 22 disposed between side frame members 24 and 26 having a plurality of underlying support fingers 28 secured thereto. Each step portion 22 is comprised of two or more lateral planks 30 and the unit is permanently nailed together. In this manner the components of system 10 are preassembled with sufficient structural rigidity to withstand predetermined weight loads in the square footage area therein provided. It may further be seen from FIG. 1 that the collapsed configuration is sufficiently small in overall size to be passed through the door of conventional mobile homes and trailers for transportation therewith. In this manner the unit can be sold and transported with mobile homes and commercial trailer units. Structural bolting members (not shown in this view) are utilized with predrilled holes in each of these structure members and preassembled sections for quick and efficient assembly.

Figure 2:
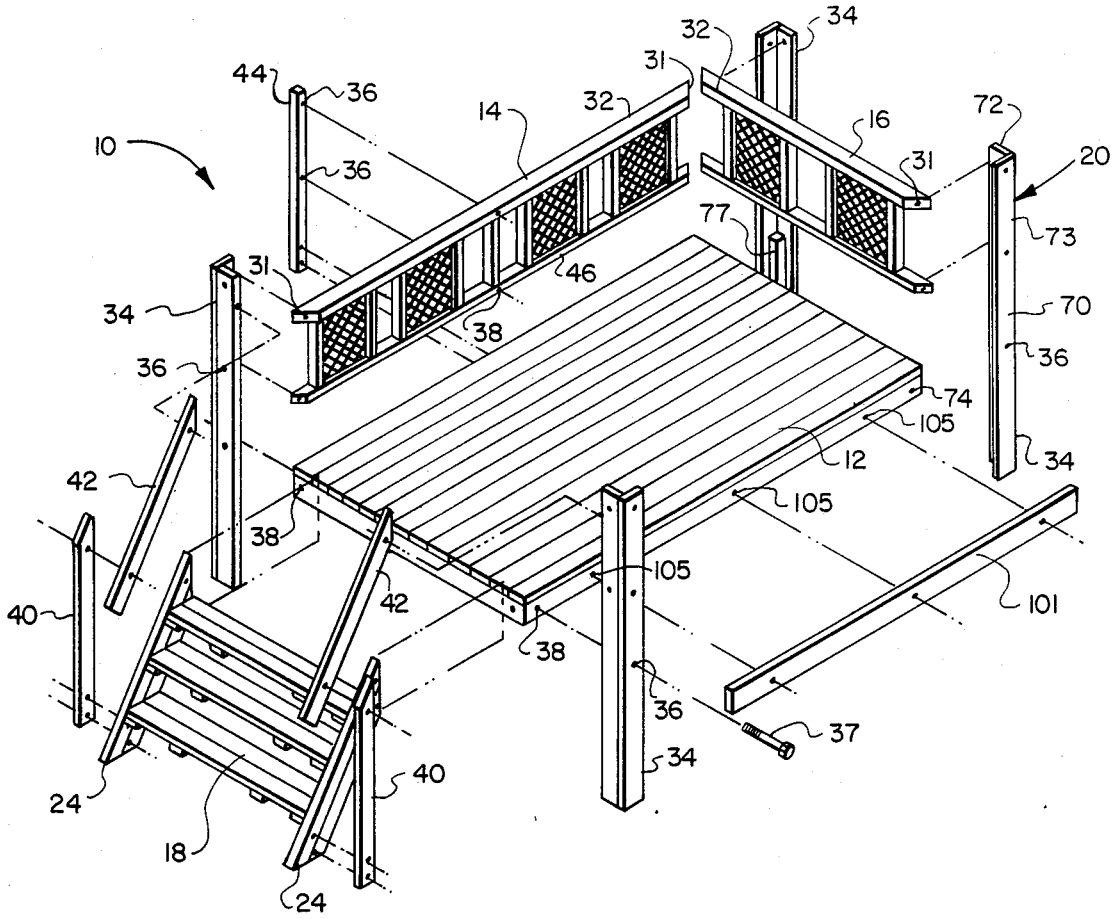
FIG. 2 is an exploded perspective view of the deck system of FIG. 1 illustrating the assembly and disassembly thereof.

Referring now to FIG. 2 there is shown an enlarged, exploded perspective view of the system 10 of the present invention wherein the platform 12 is shown to be positioned beneath longitudinal side panel 14 and end panel 16. The steps 18 are shown secured to a left end thereof. In accordance with the principles of the present invention the steps can be assembled to either end of the subject deck system 10, as can the end panel 16. The distal ends 31 of the hand rails 32 of each panel are cut at 45° angles to facilitate coupling along any end portion. Likewise the side panel 14 may be assembled on the opposite side of the platform 12 as shown herein.

Still referring to FIG. 2, the post and structure members 20 are shown to comprise 4 L-shaped corner members 34 each having a plurality of predrilled holes 36 therein aligned for registry with holes 38 formed in the platform 12 and side panels 14 and 16. A plurality of lag bolts 38 are provided for threaded entry through holes 36 and 38 and securement of the structural members one to the other.

In the present embodiment, posts 34 are assembled to the deck 12 with $\frac{3}{8}$ inch$\times 3\frac{1}{2}$ inch hex head lag bolts 37. The remaining assembly utilizes 5/16 inch$\times 3\frac{1}{2}$ inch hex head lag bolts. Likewise steps 18 include vertical members 40 adapted to secure to the side frames 24 of the steps with handrails 42 secured to the upper ends thereof and to the posts 34. A central panel brace 44 is provided for securement to the longitudinal panel 14 and to the platform 12. Brace 44 is adapted with holes 36 aligned for registry with holes 38 in the handrail 32 and base rail 46 for lag bolts 37. In this manner a structure truss is formed and coupled whereby weight upon the platform 12 is supported in a structural configuration facilitating maximum utilization of the platform 12.

Referring still to FIG. 2 the assembly of the platform 10 incorporates the lag bolts 37 of varying lengths as set forth above for penetrating the predrilled holes 36 and 38 in the various members. The lag bolts 37 can be easily inserted and removed for portability of the system 10 and permit the various discrete components comprising the deck 12, legs 34, side sections 14 and 16 and the steps 18 to remain intact before, during and after assembly. By eliminating the need for nails and other permanent fastener members in the ultimate section assembly, transportation and portability is not deleterious to the unit. Moreover, the structural integrity of the unit is not compromised by disassembly due to the fact that the lag bolts 37 provide the load bearing structural fastening elements necessary for interconnecting the various discrete components. In this manner all weight loading is transferred through the lag bolt junctions and the design of system 10 incorporates maximum utilization of this assembly technique for facilitating a plurality of assembly and disassembly operations. Platform 12 is thus usable either upon the ground or upon water when secured to pontoons and the like as described in more detail below.

Figure 3:
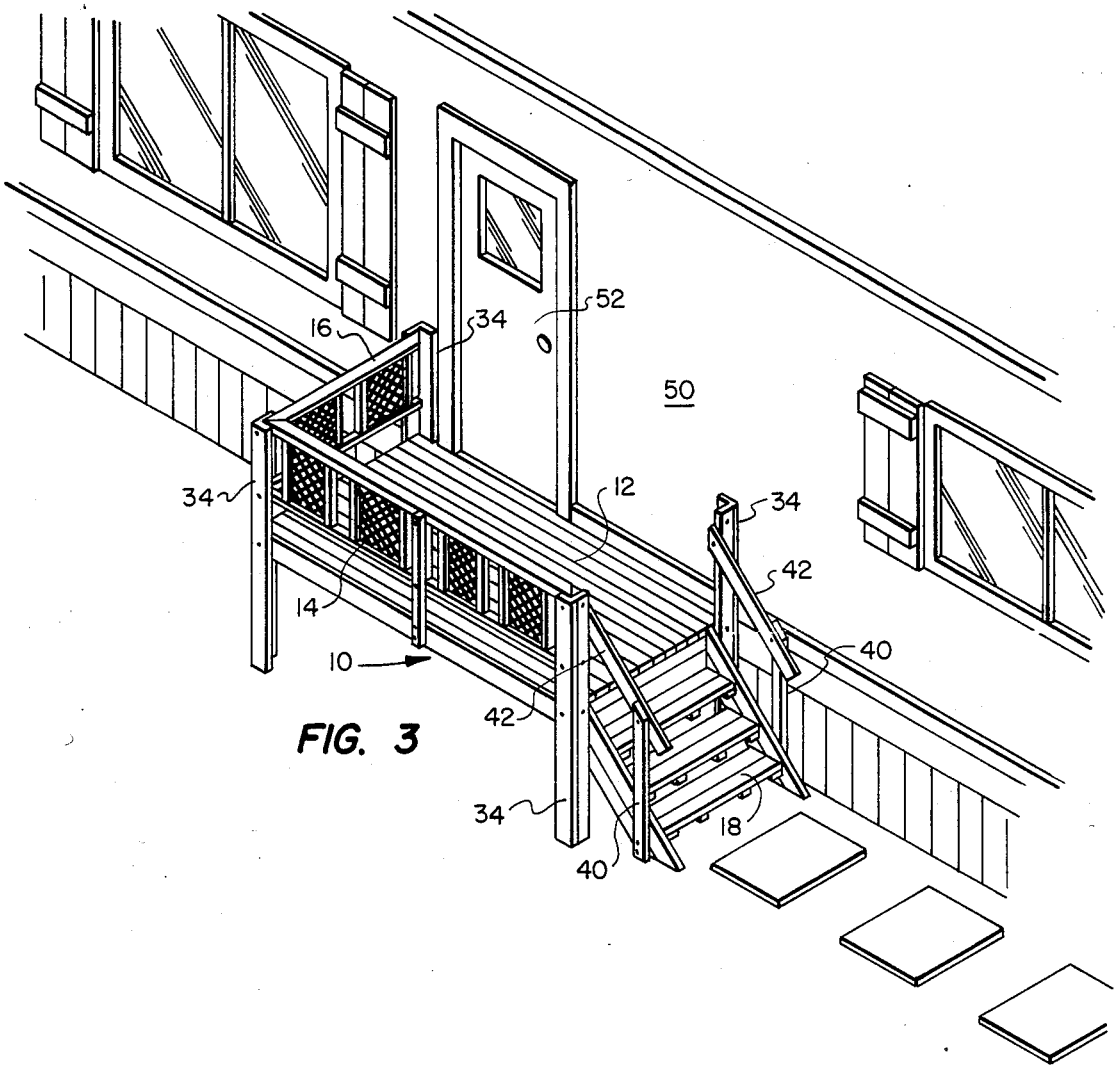
FIG. 3 is a perspective view of the deck assembly of FIG. 1 assembled adjacent a portable structure.

Referring now to FIG. 3 there is shown a perspective view of the system 10 in an assembled configuration adjacent a mobile structure 50. The platform 12 is shown assembled to the stairs 18 with the longitudinal brace 14 provided in a truss configuration therewith. End brace 16 is disposed on the distal end of the platform 12 opposite the stairs 18 while the posts 34 secure both the outside and the inside corners of the platform 12 to the mobile unit 50. Handrails 42 are shown coupled directly to the end posts 34 as well as to the upstanding braces 40. In this manner structural integrity is provided in the assembly of the present invention. It may be seen that the doorway 52 of the mobile home 50 would obviously be too small to receive the deck 10 in its assembled condition. As seen above in FIGS. 1 and 2, the disassembled structure may easily be passed through the doorway 52 for shipment with the mobile home system. Since assembly of the system 10 only takes a finite period of time, on the order of one hour, utilization of the deck 12 is greatly facilitated and is not a major element of the "set-up" of a mobile home. Much more time is necessary for leveling and securing the mobile home structure than is necessary for assembly and securement of the deck system 10 thereto.

Figure 4:
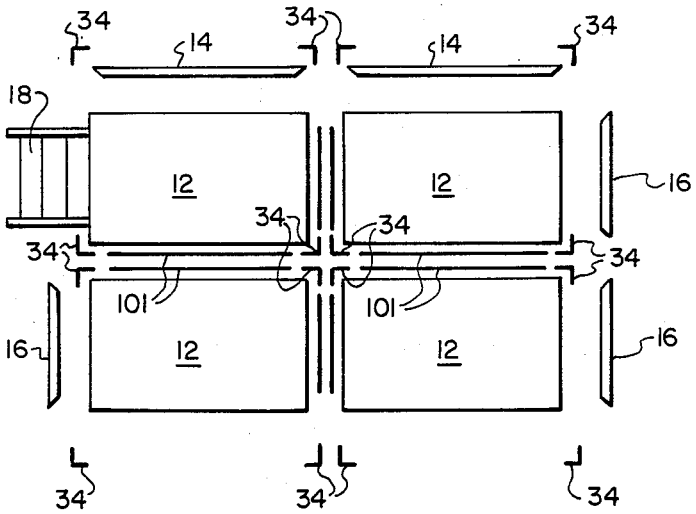
FIG. 4 is a diagrammatic representation of the expansion assembly of the deck system of the present invention.

Referring now to FIG. 4, there is shown a diagrammatic illustration of one expansion embodiment of a single platform 12 with a plurality of platforms 12 in orthogonal directions. Expansion, in accordance with the present invention, does not compromise the structural integrity because the structural members are directly interconnected. Additional sections are simply secured one to the other with lag bolts 37 running between the structural members thereof as shown herein. Connecting boards 101 are provided for placement between the legs 34 of each deck section 12 for facilitating flush engagement with the abutting deck section 12 and the entry of the lag bolt 37 therethrough for securement of one deck structural member to the other, as shown in FIG. 4. Each board 101 and the deck 12 is pre-drilled with lag bolt apertures 105 which align during assembly. This aspect is representatively shown in FIG. 2 wherein an expansion board 101 is illustrated adjacent the platform 12. In this manner bi-directional expansion of the deck system can be incorporated with the structural legs 34 extending down to the ground or onto pontoon members 103 for support thereof. Each deck is therefore supported in its original configuration but coupled to other deck sections which in and of themselves are self-sustaining and supportable. Interconnection therebetween is not a structural weakness in the present invention due to the fact of the independent support of each deck. The truss framework comprised by panel member 14 coupled to platform 12 is structurally independent between each post 34 as shown in FIGS. 2 and 3 and therefore the security of one deck is not compromised by assembly to any of a plurality of decks. In this manner, pontoons 103 may be secured to the post members 34 or the post members modified by the particular users for placement upon a body of water. Moreover, the posts 34 may be secured within the ground for more permanent placement in the form of a walkway through wooded areas or around lake areas.

Referring now to FIGS. 2 and 4 in combination, it may be seen that the assembly and disassembly of the present invention is greatly facilitated by the fixed discrete sections 12, 14, 16 and 18. The utilization of the structural members 20 in conjunction therewith provide a unit which is self-sustaining and yet may be disassembled and placed in a compact configuration for shipment. In this manner, stages, platforms, piers, walks, decks and other assemblies may be quickly and easily incorporated by the utilization of a single unit having known structural characteristics which are not dependent upon the size of the structure itself. Moreover, the structural characteristics of the particular unit are adapted for maximum support thereon whereby collateral considerations as to aesthetics and access may be addressed. The fabrication of the system 10 out of pressure treated wood or the like, likewise facilitates the low cost assemblage and affords a manner of providing an aesthetically pleasing deck structure in a lightweight configurations with the minimum of cost. For example each of the discrete sections may be assembled upon a preselected jig for aligning both the members one to the other for fastening through a pneumatic fastener such as nail guns and the like. Each leg 34 comprises first and second longitudinal members 70 and 72 (as shown in FIG. 2) which are nailed along a single side 73 for securement one to the other. The L-shaped configuration then matingly conforms to the corner 74 of the platform 12 and to the distal ends 31 of the handrail 16. An inside leg brace 77 is preferably included within the L-shaped members 72 and 73 for receiving the weight of platform 12 during the assembly and for further enhancing the rigidity of the assembly of members 72 and 73 one to the other. The platform 12 may then initially be placed to rest upon the inside leg braces 77 disposed in the orthogonal intersection of the leg members 34.

It is thus believed that the operation and construction of the present invention will be apparent from the foregoing description. While the method and apparatus shown and described has been characterized as being preferred, it will be obvious that various changes and modifications may be made therein without departing from the spirit and scope of the invention as defined in the following claims.

What is claimed is:

1. An improved deck system of the type in a wooden platform is constructed with side panels at least partially therearound and steps providing access thereto, wherein the improvement comprises a portable deck structure including a fixedly assembled platform, fixedly assembled longitudinal side panel, fixedly assembled end panel, fixedly assembled step section and plurality of structural members adapted for securing said platform, steps, side and end panels one to the other and to a supporting surface, said longitudinal side panel further being constructed in the form of a structural truss and including a center attachment beam for coupling an intermediate section of said platform to said side panel, and said side panels being adapted for interchangeability on opposite sides and ends of said platform, said step section being adapted for securement to either end of said platform, and said platform being adapted for attachment to a second platform positioned on end or side thereof facilitating bi-directional expansion of said deck.

2. The deck system set forth in claim 1 wherein said structural members comprise L-shaped corner posts at the apertures formed therethrough adapted for receiving a plurality of lag bolts, said lag bolts adapted for being received through said apertures in said posts and said platform having a plurality of apertures formed therein adapted for alignment and registry with said apertures of said posts for the receipt of said lag bolts therein.

3. The apparatus as set forth in claim 1 wherein said platform and said side panels and said steps are formed of pressure treated wood.

4. The apparatus as set forth in claim 1 wherein said side and end panels include upper and lower elongate rails and lattice members positioned therebetween, said upper and lower rails having opposite ends cut at 45° angles facilitating orthogonal engagement therebetween on opposite ends thereof for facilitating selection and mounting to said platform.

5. The apparatus as set forth in claim 1 wherein said structural members comprise L-shaped corner posts having planar members secured orthogonally one to the other adapted for securement to said platform wherein said deck system further includes planar members adapted for securement to the sides of said platform between said L-shaped corner posts and having a thickness substantially equivalent to said L-shaped corner post planar members for facilitating the bi-directional expansion of said deck and presenting a substantially planar surface generally flush with said L-shaped corner post members for securement of adjacent platform sections in said bi-directional expansion.

6. The apparatus as set forth in claim 1 wherein said platform sections are constructed with the width thereof on the order of one-half of the length of said platform for facilitating bi-directional expansion thereof.

7. The apparatus as set forth in claim 1 wherein said fixedly assembled platform, side panel, end panel, and steps are constructed of wood and are secured by nails driven therethrough for the permanent assembly thereof.

8. The apparatus as set forth in claim 1 wherein said structural members comprise L-shaped corner posts for securement to said platforms, and wherein said corner posts further include a block secured therein adapted for engaging a corner area of said platform and supporting said platform thereupon.

9. The apparatus as set forth in claim 1 wherein said deck system further includes a plurality of pontoons and wherein said structural members are adapted for securement to said pontoons for facilitating the flotation of said platform upon a body of water.

10. An expandable deck system comprising:

a fixedly assembled wooden platform;

at least one fixedly assembled, longitudinal side panel formed with load bearing members comprising a structural truss and including a center attachment beam adapted for coupling to an intermediate section of said platform for the structural support thereof;

at least one fixedly assembled end panel adapted for securement to said platform;

at least one fixedly assembled step section adapted for securement to said platform for providing access thereto;

a plurality of structural members adapted for securement to and the support of said platform and said side and end panels thereto, said structural members comprising L-shaped corner posts having planar members secured orthogonally one to the other adapted for matingly engaging corners of said platform;

expansion board members adapted for securement to said platform between said L-shaped corner posts and having a thickness substantially equivalent to the thickness of said L-shaped corner post planar members for providing a generally planar surface in flush engagement with said L-shaped corner posts for securement of one platform section to another and the expansion of said platform area; and means for securing said platform, side panel, end panel, step section, structural members and said platform sections one to the other.

11. The apparatus as set forth in claim 10 wherein said securement means comprises a plurality of lag bolts adapted for passage through said members of said deck system and wherein said platform side panels, structural members and expansion board members are constructed with apertures formed therethrough adapted for registery one with the other in the assembled configuration for facilitating the receipt of said lag bolts therethrough.

12. The apparatus as set forth in claim 10 wherein said platform and said side panels and said steps are formed of pressure treated wood.

13. The apparatus as set forth in claim 10 wherein said side and end panels include upper and lower elongate rails and lattice members positioned therebetween, said upper and lower rails having opposite ends cut at 45° angles facilitating orthogonal engagement therebetween on opposite ends thereof for facilitating selection and mounting to said platform.

14. The apparatus as set forth in claim 10 wherein said platform sections are constructed with the width thereof on the order of one-half of the length of said platform for facilitating bi-directional expansion thereof.

15. The apparatus as set forth in claim 10 wherein said fixedly assembled platform, side panel, end panel, and steps are constructed of wood and are secured by nails driven therethrough for the permanent assembly thereof.

16. The apparatus as set forth in claim 10 wherein said structural members comprise L-shaped corner posts for securement to said platforms, and wherein said corner posts further include a block secured therein adapted for engaging a corner area of said platform and supporting said platform thereupon.

17. The apparatus as set forth in claim 10 wherein said deck system further includes a plurality of pontoons and wherein said structural members are adapted for securement to said pontoons for facilitating the flotation of said platform upon a body of water.

* * * * *